United States Patent [19]

Roccograndi et al.

[11] 4,386,439

[45] Jun. 7, 1983

[54] BEDSPREAD

[76] Inventors: Yolanda C. Roccograndi; Daniel M. Roccograndi, both of 29 Fordham Rd., Laflin, Pa. 18702

[21] Appl. No.: 294,373

[22] Filed: Aug. 18, 1981

[51] Int. Cl.[3] ..... A47G 9/02

[52] U.S. Cl. ..... 5/498; 5/493; 5/502

[58] Field of Search ..... 5/495, 497, 496, 498, 5/499, 501, 493, 486, 494, 500, 502; D6/258-263

[56] References Cited

U.S. PATENT DOCUMENTS

| | | | |
|---|---|---|---|
| 2,449,758 | 9/1948 | Wikmark | 5/502 |
| 3,962,739 | 6/1976 | Crocket | 5/500 |
| 4,014,055 | 3/1977 | Torres | 5/497 |
| 4,274,169 | 6/1981 | Standiford | 5/502 |

*Primary Examiner*—Alexander Grosz
*Attorney, Agent, or Firm*—A. A. Saffitz

[57] ABSTRACT

A low-cost bedspread to permit fresh sheets and blanket to be fitted on the bed when the bedspread is removed, said bedspread comprising as the lining for the bedspread a fitted sheet having elastic strip material sewn to its lower edge adapting the encasing of the mattress and the lining having a bedspread sewn thereto along a rectangular seam to said fitted sheet within a spaced marginal portion between said seam and the mattress to permit the covering of one or more pillows beneath said bedspread at the top of the mattress. After stripping the bedding the assembly of the fitted lining and bedspread the assembly is quickly fitted about the mattress to provide the appearance of a completely made bed. Preferably the seam which sews the bedspread to the fitted lining is a double seam to assure that there be no unintended separation of the spread from the lining due to catching or snagging. In a preferred embodiment a double skirt is gathered and ruffled is provided to enhance the appearance of the spread. The material cut out of the fitted lining within the double seam can be used to make the ruffle, thereby lowering the cost and more efficiently utilizing the material.

8 Claims, 6 Drawing Figures

BEDSPREAD

BACKGROUND OF THE INVENTION

1. Field of the Invention

This invention lies in the field of bed clothing and more specifically in the field of bed equipment of the type disclosed and claimed in Wikmark U.S. Pat. No. 2,449,758, which is classified in class 5, bed clothing, subclass 495. This invention further lies in the class of bedspreads as in the patent to Hazel M. Ragsdale Mazera, et al. U.S. Pat. No. 3,144,666, which is classified in class 5, subclass 497.

2. Description of the Prior Art

The patents of which I am aware recognize the problem of avoiding daily bed-making to include the changing of sheets by proposing bed equipment of the type shown in Wikmark U.S. Pat. No. 2,449,758. Wikmark constructs a rectangular casing in which the top and bottom portions are detachable one from the other, the bottom portion being longer at the top at the head end and a zipper to connect top and bottom and along the sides. The construction of the Wikmark equipment depends for its long-time serviceability upon the maintenance of the zipper fastener in good condition and there is no special decorative bedspread appearance which is a requirement in hotels and motels where high quality standards are maintained.

In U.S. Pat. No. 1,701,038, a mattress cover is proposed in which flannel is sewen to the top but in this embodiment the appearance is that of flannel and there does not result the formal appearance associated with a tastefully formal bedroom in which the beds are each provided with bed spreads having a formal finished appearance which is a requirement in a hotel or motel dealing with the public.

In the patent to Mazera, et al. U.S. Pat. No. 3,144,666, a formal bedspread such as employed in hotels and motels is described in which an under spread and an over spread are combined, both the under spread and the over spread being attached to skirts of the type which are acceptable in the hotel and the conventional cover spread and under spread are provided with special means to engage the sides of the box spring to hold the under spread in place. A further teaching of this patent is for bed clothing holding means comprising a single band between the head end vertical edges of the border skirt parts which engages the head end of the mattress. The single band and the elastic strip means are used to anchor the beadspread in place. No provision is made to cover the pillow. There is no special construction for the top spread which is shown to make the assembly adaptable for a hotel or motel.

In the U.S. patent to Sylvia B. Esperson, U.S. Pat. No. 3,148,388, a combination pillow holding envelope and bed sheet is proposed in which the pillow is permanently attached to make it difficult for children to take the pillow and thereby discourage the use of the pillow for pillow fights.

In the U.S. patent to Beer, U.S. Pat. No. 3,530,487, it is proposed to releaseably fasten the bedspread to the mattress in a specific manner to permit the user to move the top sheet and blanket while these give the appearance of close conformity before separation by the sleeper. This is accomplished by elastic bands interposed between the edges of the top sheet and blanket.

Fiber interengaging fasteners of the type available under the trademark VELCRO are used.

In the U.S. patent to Deutsch, U.S. Pat. No. 3,467,974 there is described a bed covering comprising a comforter of quilt construction in which specific sewn patterns are employed and stitching lines are used to give rectangular configurations with square cutouts at two adjacent corners. Special fasteners are employed to fasten the exposed edges of the comforter.

Ainsworth in U.S. Pat. No. 3,965,504, shows a bedding assembly for camping which brings together five bedding elements, a top sheet, blanket, bedspread, etc. each with fiber interengaging fasteners of the type available under the Trademark "VELCRO" to aid in assembly and disassembly.

DIFFERENCES OVER THE PRIOR ART

Certain of the bed clothes of the prior art do not meet the formal appearance requirements for hotels and motels in which color matched bedspread and color matching drapes and other decorations such as pilow decoration are required for the guests. In particular, U.S. Pat. Nos. 1,701,038; 3,148,388; 2,449,758; and 3,965,504 do not have the style and appearance requisites which are needed to meet the requirements of the innkeeper.

Patents such as U.S. Pat. Nos. 3,467,974 and 3,144,666, although more conventional in appearance, do not meet the requirements of hiding the pillows when the bedspread is smoothed on the bed as in the making of the bedspreads for hotels and motels. In general the prior art requires specialized fastener constructions which add cost without in any way improving the appearance or facilitating the assembling or disassembling of the bedspread to the mattress.

Accordingly, it is a feature of the invention that the only fastening means consists of an eleastic strip in the fitted lining which fits lining to the mattress and with the bedspread itself. The bedspread itself is formal in style and appearance and has two skirts which are sewn along a rectangular seam at the edge of the bedspread. The bedspread is long enough to permit the pillows to be completely covered with the spread when it is in place on the mattress with the lining serving as the sole holding means for the assembly to the mattress.

OBJECTS OF THE INVENTION

It is an object of the invention to provide a low cost, attractive, sturdily constructed formal bedspread assembly especially constructed to fit the mattress comprising a fitted lining having elastic strip material sewn to its lower edge for fitting to the mattress and a bedspread having a double skirt at the sides and a central rectangular portion at the top which has substantially the same dimensions as the mattress and said top being sewn by a rectangular seam to the top of the fitted lining and said seam being spaced inwardly substantially the same distance on top, bottom and sides to adapt the top to hide one or more pillows.

A further object of the invention is to provide a bedspread assembly which lies flat over a pillow, is economical to make and has a double panel used as a dust ruffle which may be flat or may be made in a gathered ruffle style.

Further objects will be apparent from the drawing, detailed description and claims.

SUMMARY OF THE INVENTION

This invention relates to a low-cost, attractive, sturdily constructed bedspread assembly especially constructed to avoid daily bed-making comprising a fitted lining having elastic strip material sewn to its lower edge for fitting to the mattress and a bedspread having a double skirt at the sides and a central rectangular portion at the top which has substantially the same dimensions as the mattress and said top being sewn by a rectangular seam to the top of the fitted lining and said seam being spaced inwardly substantially the same distance on top, bottom and sides to adapt the top to hide one or more pillows.

BRIEF DESCRIPTION OF THE PREFERRED EMBODIMENTS

Figure 1:
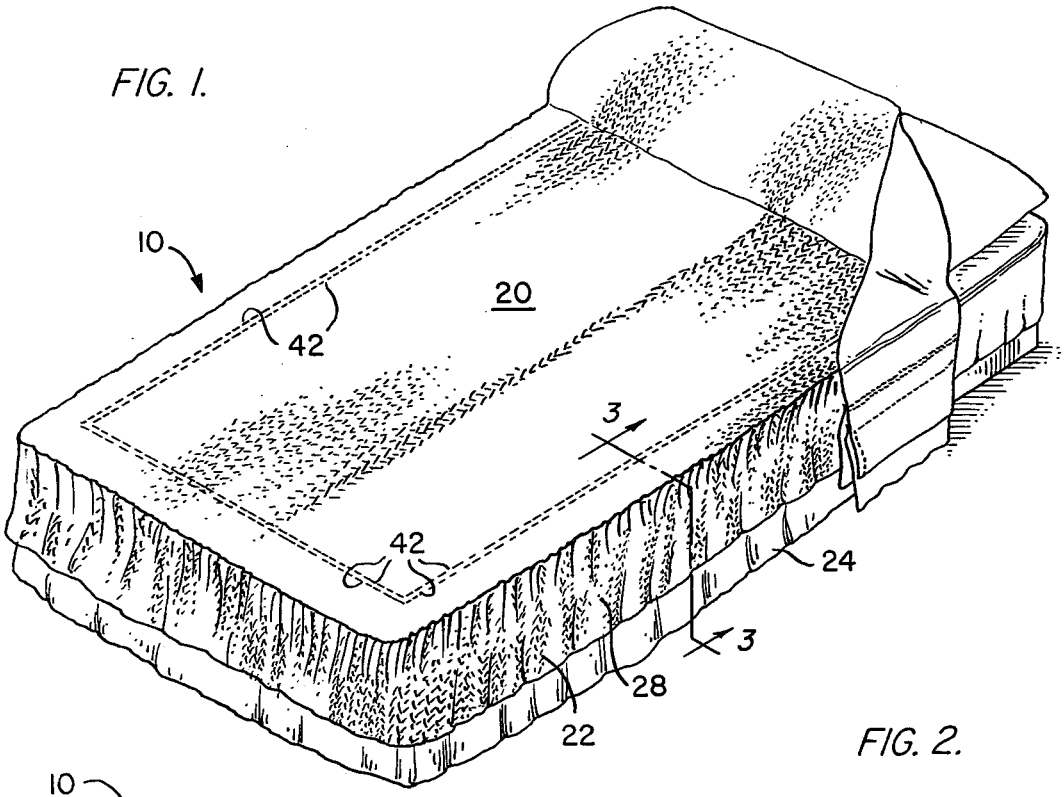
FIG. 1 is a perspective view partly in section showing the bedspread assembly of the invention fitted to a double bed and mattress.

In FIG. 1 there is shown the bedspread assembly 10 of the invention which is especially adapted to fit the mattress of a double bed. The bedspread assembly comprises a top 20 and a fitted lining 30, the fitted lining being adapted to encircle the mattress 15 by the gathered elastic strip 17 which lines the edge of the four sides of the open bottom of the lining. The bedspread top 20 is preferably cut from a heavy fabric of high quality and has a double side panel comprising a short panel 22 and a longer panel 24, both short and long panels being sewn as a unit around the four sides of the edges of the top. Spaced inwardly from the lower panel 22 is the upper side panel 28 which is offset by a margin designed to permit a contrasting color in the upper ruffle or panel as compared with the lower double panel. The location of the upper dust panel of matching color 28 is dictated by the conformation of the flat portion of the top of the bedspread assembly top 20 which in turn depends on the thickness of 20, the lining having a cut out portion within the seams 42.

Figure 2:
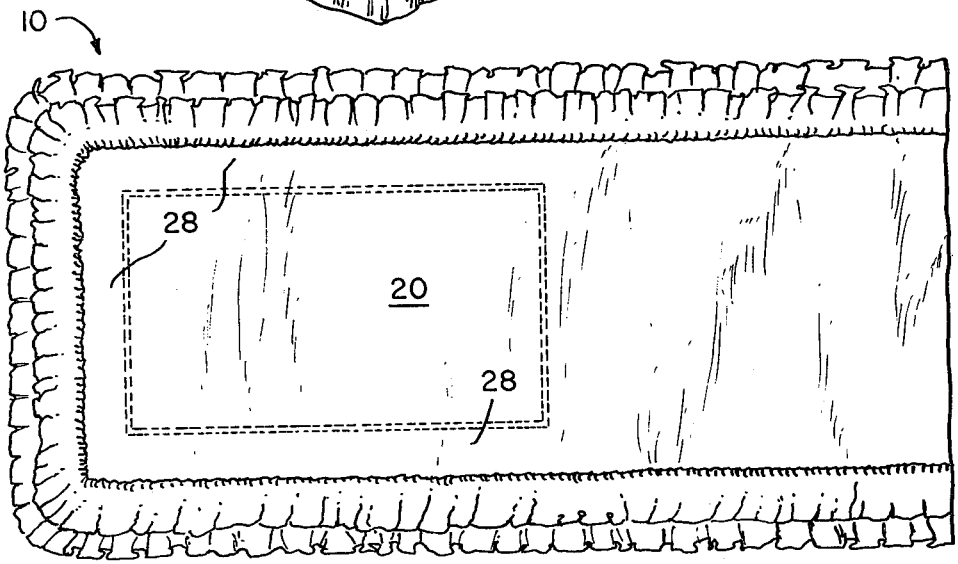
FIG. 2 is a top plan view showing the top of the bedspread of FIG. 1 with attached side panel.
Figure 3:
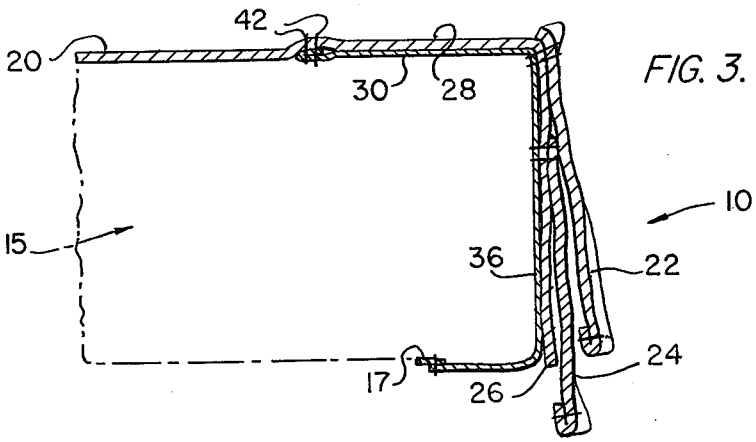
FIG. 3 is a sectional view along line 3—3 of FIG. 2.

For the purposes of attachment in the preferred embodiment of double bed in FIGS. 1–3, a double seam 42 is sewn at the inwardly spaced portions illustrated, the outer stitching of the double seam 42 being spaced inwardly an equal amount from each top dust ruffle edge and the same amount from the bottom so that effectively three sides including the bottom side are held by means of the seam inset by substantially the same distance. The distance between the top of the seam and the top of the bed is the same as that of the sides but an additional length of the bedspread in the top is permitted which allows one or more pillows to be covered. The cut out portion of the lining provides material from which the panel 26 is cut, this panel 26 being shown in FIG. 3. Thus there is achieved an economy of material, even for the lower cost thinner material of the lining 30 which is shown in FIG. 3 to be thinner than the heavier fabric of the bedspread 20.

Figure 4:
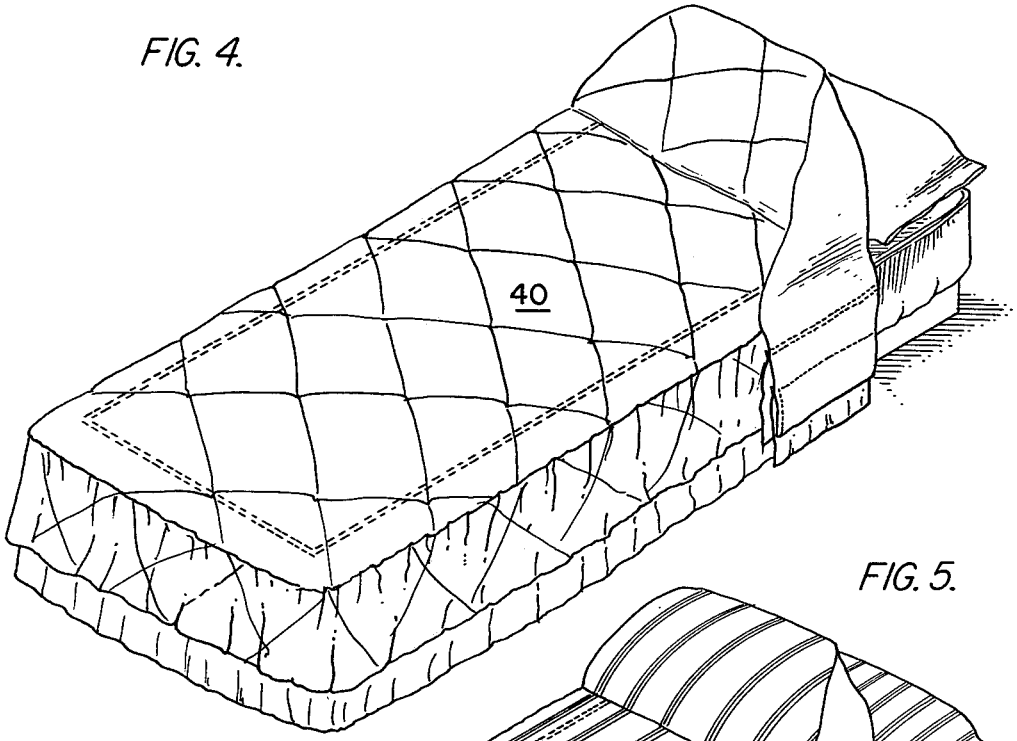
FIG. 4 is a perspective view partly in section showing the bedspread assembly of the invention fitted to a single bed and mattress in which the bedspread is of quilted construction.
Figure 5:
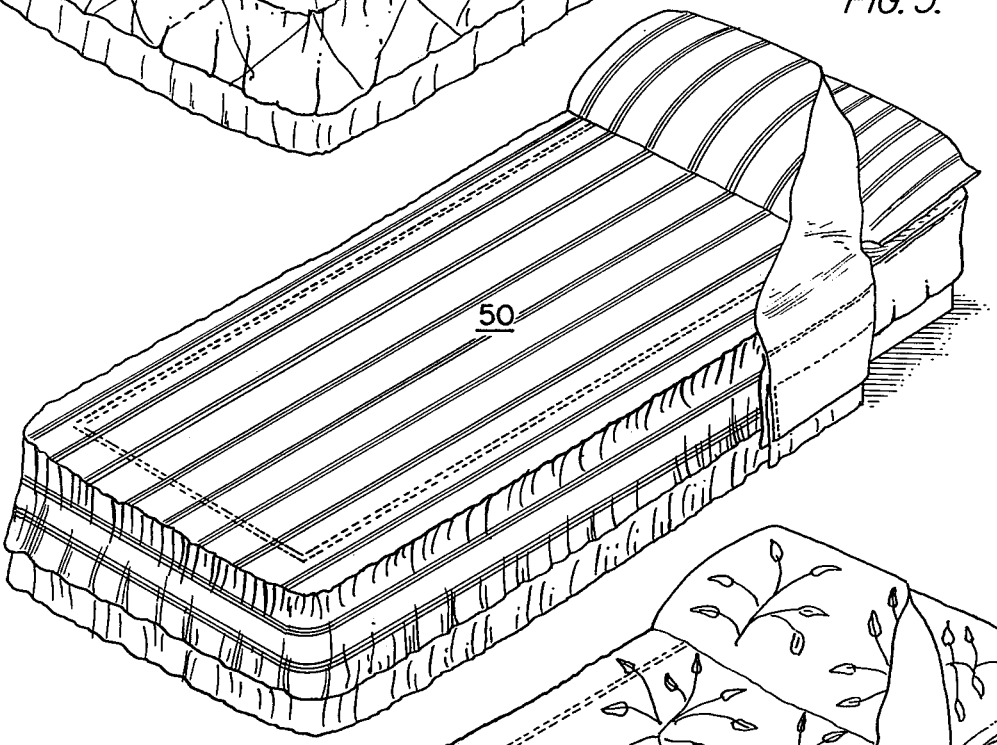
FIG. 5 is a perspective view partly in section showing a modification of the bedspread assembly of the invention fitted to a single bed and mattress wherein the bedspread is of a corduroy construction.
Figure 6:
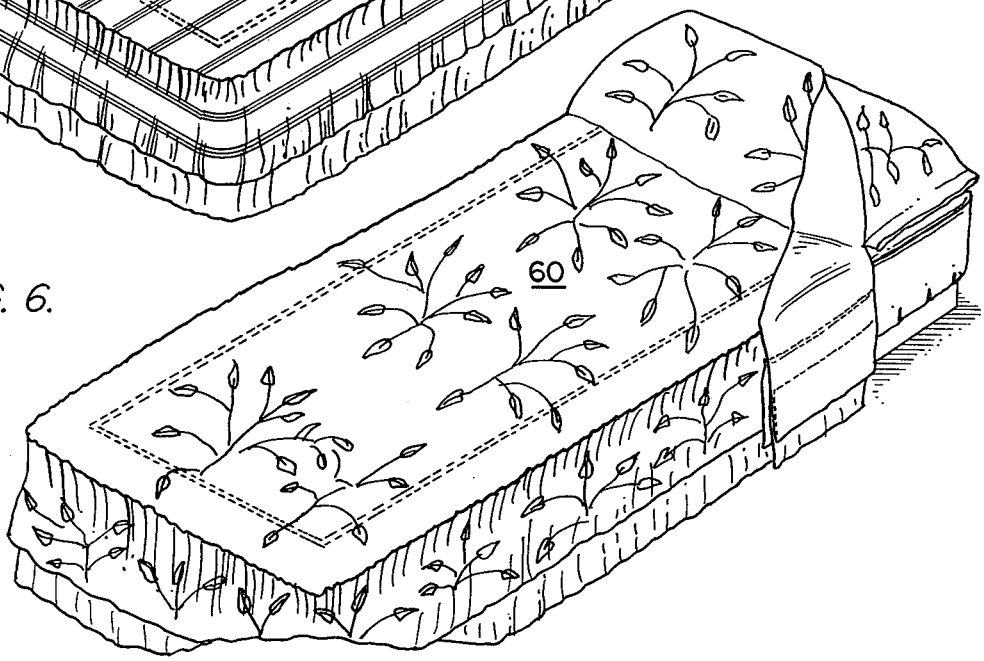
FIG. 6 is a perspective view partly in section showing the bedspread assembly of the invention fitted to a single bed and mattress in which the bedspread is in the form of a cotton floral print.

More commonly used in hotels and motels than the double bed assembly shown in FIGS. 1–3 is the single bed assembly as shown in FIGS. 4–6. In FIG. 4 there is illustrated a heavy quilted top, in FIG. 5 a corduroy top and in FIG. 6 a printed high quality cotton top all for the single bed of the type in a hotel.

In the bedspreads of FIGS. 4, 5 and 6 the tops are designated reference numerals 40, 50 and 60 respectively. Ruffles as in FIG. 1 are provided for the double side panels 22 and 23 in FIGS. 4 and 5 which show smooth side panels for the heavy corduroy. These ruffles are absent from FIG. 6. Obviously, it is contemplated that pleats instead of ruffles be used with the corduroy bedspread 50 if so desired.

Having thus disclosed the invention what is claimed is:

1. A bedspread assembly for quickly fitting over a mattress and adapted to be held by a single elastic means comprising:

a rectangular fitted lining having elastic strip material sewn to its lower edge which constitutes the single elastic means adapting the encasing of the mattress;

a bedspread sewn along a rectangular seam to said fitted lining within a spaced marginal portion inward from the mattress;

the seam spacing being substantially the same at the bottom of said mattress and at the two sides of said mattress whereby the assembly of fitted lining and bedspread is adapted to cover one or more pillows at the top of the bedspread and to provide the appearance of a completely made bed in which fresh sheets and blanket are present;

a double side panel including a longer panel and a short panel sewn to the top of said bedspread which extends around the bottom of the bed and extends around the two sides of said bed;

the material of said bedspread and said double side panel being heavier than the material of said lining;

an added side panel of lighter material having the same weight as said liner attached beneath said double side panel and said rectangular fitted lining being cut out within said rectangular seam and being sewn along a folded cut out line to fit the lining and bedspread closer to said mattress.

2. A bedspread assembly as claimed in claim 1 wherein said bed and said mattress is a double bed.

3. A bedspread assembly as claimed in claim 2 wherein said double side panel sewn to the top of said bedspread is sewn with gathering and ruffles.

4. A bedspread assembly as claimed in claim 3 wherein said bedspread has a pattern at the top which is repeated in the gathering and ruffles of the double side panel.

5. A bedspread assembly as claimed in claim 1 wherein said bed and said mattress is a single bed.

6. A bedspread assembly as claimed in claim 5 wherein said bedspread is a quilted bedspread.

7. A bedspread assembly as claimed in claim 5 wherein said bedspread is a corduroy bedspread.

8. A bedspread assembly as claimed in claim 5 wherein said bedspread is a heavy cotton bedspread.

* * * * *